United States Patent [19]

Selengowski et al.

[11] 4,306,720

[45] Dec. 22, 1981

[54] PASSER AND KICKER FOR ELECTRIC FOOTBALL GAME

[76] Inventors: Stanley J. Selengowski, 13262 Banbury Ct., Shelby Township, Utica County, Mich. 48087; Mitchell J. Selengowski, 14631 Alma, Sterling Hts., Mich. 48078

[21] Appl. No.: 167,823

[22] Filed: Jul. 14, 1980

[51] Int. Cl.[3] ..... A63B 67/00; A63F 7/06; A63F 7/10

[52] U.S. Cl. ..... 273/94; 124/7

[58] Field of Search ..... 124/7; 273/94, 85 R, 273/85 C, 85 D

[56] References Cited

U.S. PATENT DOCUMENTS 1,145,955 7/1915 Wittstein ..... 273/94 R
3,273,282 9/1966 Berry ..... 273/94 R X
3,389,912 6/1968 Friedman ..... 273/94 R

*Primary Examiner*—George J. Marlo
*Attorney, Agent, or Firm*—Remy J. VanOphem

[57] ABSTRACT

A vibrating surface type simulated football game is disclosed in which high accuracy passer and kicker figures have calibrated passing and kicking ranges on the playing surface corresponding to actual player passing and kicking ranges. Pockets formed in movable members of the passing and kicking figures enable free exit of the projectile upon movement of the member against a fixed stop. The passing and kicking movable members are rotated by the player to various compressed positions of a coil compression spring each corresponding to a calibrated range of the projectile and released to move the member against the fixed stop position to provide highly accurate trajectory of the projectile.

7 Claims, 11 Drawing Figures

PASSER AND KICKER FOR ELECTRIC FOOTBALL GAME

BACKGROUND DISCUSSION

There has been heretofore provided widely marketed simulated football games of a vibrating surface type, in which a surface is provided with markings corresponding to the football gridiron and a corresponding number of players which are arrayed by the players on the playing surface. A vibrator mechanism causes the players to be advanced to simulate an actual football game.

Such have games heretofore been provided with passing and kicking figures in which passing plays are simulated by means of a special figure adapted to cause a projectile to be released and directed towards a corresponding player, impact of the projectile indicating a completed pass play or interception if the player impacted is an opposing player. Similarly, kicking figures are provided to execute punting and field goal plays.

Heretofore such figures have produced relatively low accuracy and the ranges of the figures bears no relationship to an actual capability of human players, in terms of the distances of the gridiron markings. Accordingly, in such electric football games as heretofore been provided, such passing and kicking has played but a minor role in the playing of the game.

Such inaccuracy was due in part to the method of projecting the projectile, that is, the projectile was secured to a resiliently deflectable member of either the passer or kicker in such a way that release was erratic, affecting the trajectory and range of the projectile. In addition, the means of propelling the projectile was determined by the resilience of the member which resilience is such as to enable a very much greater range of the passer or kicker than that corresponding to an actual human player in terms of the dimensions of the playing surface.

Such games have been extremely simple in configuration in conformance with the economic realities of marketing such games. That is, these figures must be relatively simple so as to be able to be manufactured cheaply.

Accordingly, it is an object of the present invention to provide an electric football game of the type described in which highly accurate passer and kicker figures are provided which figures have respective passing and kicking ranges and accuracy generally corresponding to that of an actual player in terms of the dimensions of the football playing surface.

It is another object of the present invention to provide such passer and kicker figures which are simple in configuration and yet provide highly accurate passing and kicking such as to improve this aspect of such games so as to be a much greater factor in the game, and to thereby enhance the overall interest in playing the game.

SUMMARY OF THE INVENTION

These and other objects of the present invention are provided by passer and kicker figures having calibrated propelling means which sets the maximum range thereof to the 50 or 60 yard passing and punting average out of actual players in terms of the dimensions of the playing surface. Such calibration is achieved by passing and kicking figures, each having pivotally mounted members which are rotated so as to compress a coil spring to fully or partially compressed positions. The spring rate is calibrated such that upon release of the member and rotation against the fixed stop, the proximate range of the projectile from release from the fully compressed position is approximately 50 or 60 yards in terms of the dimensions of the playing surface. The highly accurate results are achieved by a pocket formed in the pivoted member of the figures comprised of an elongated bore loosely receiving the projectile, the bore extending along an axis normal to the radius of rotation of the member, such that the projectile is ejected from the pocket with minimal contact such as to be projected in a highly accurate and repeatable manner. The passer and kicker figures are of simple construction, including a base having a pivotally mounted passing or kicking member, respectively corresponding to the passing arm or kicking leg of the player and which after release swing towards a fixed stop member under the influence of helical compression spring engaging the passing or kicking member. The fixed stop projects into the path of the movable member and its location is selected to produce a controlled trajectory of the projectile resulting in highly accurate passing and kicking.

DETAILED DESCRIPTION OF THE DRAWINGS

In the following detailed description, certain specific terminology will be employed for the sake of clarity and a particular embodiment described in accordance with the requirements of 35 U.S.C. 112 but it is to be understood that the same is not intended to be limiting and indeed should not be so construed inasmuch as the invention is capable of taking many forms and variations within the scope of the appended claims.

Figure 1:
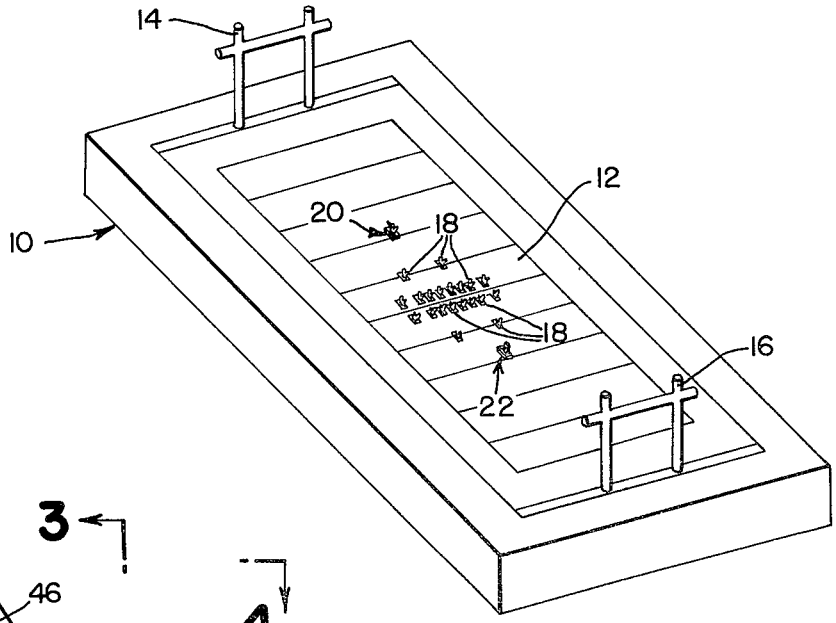
FIG. 1 is a perspective view of an electric football game of the type described.
Figure 2:
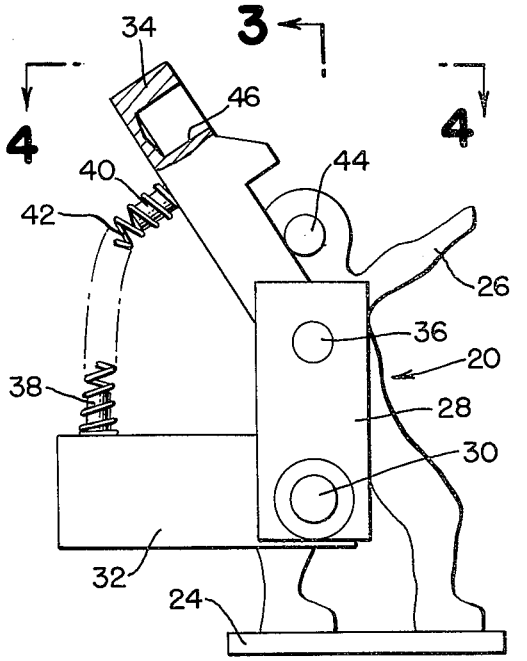
FIG. 2 is an enlarged side elevational view of a passing figure according to the present invention.
Figure 3:
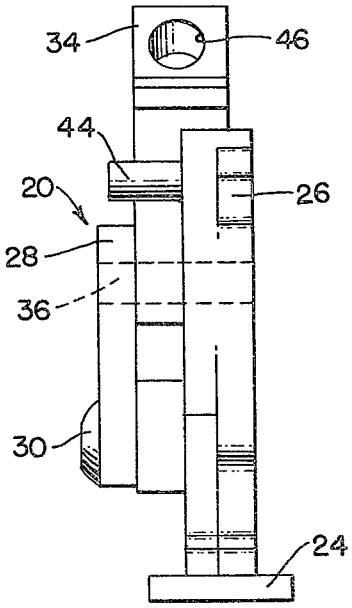
FIG. 3 is an frontal elevation view of the passing figure shown in FIG. 2.
Figure 4:
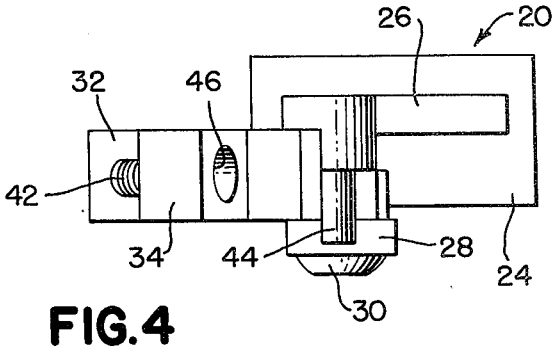
FIG. 4 is a plan view of the passing figure shown in FIGS. 2 and 3.

Referring to the drawings and particularly FIG. 1, an electric football game of the type described is depicted. This includes a game board 10 formed with an upper surface 12 simulating a football playing field with appropriate markings as shown. Goalposts 14 and 16 are provided on either end of the playing surface 12 all of which are proportioned in dimension and such as to correspond to an actual football playing field. Player figures 18 are provided which are arrayed for each play as is well known to those skilled in the art. A vibrating mechanism (not shown) causes the sheet metal layer, providing the playing surface 12 to be vibrated while a play timer controls the duration of each play. The player figures 18 are designed such as to be caused to move forwardly or in a particular direction in response to the vibration of the playing surface 12. The direction of movement is controlled by mechanisms provided in the players 18, and variations in the rate of vibration as to the playing surface 12 cause variations in the speed of movement. Inasmuch as the details of play and construction of such electric football games is well known, these various details and components such as the game timer and the vibrating mechanism, will not be herein described.

The improvement to the game according to the present invention is to provide much improved passer and kicker figures such as to fundamentally alter the way the game is played.

A passer figure is indicated at 20, while the kicker figure is indicated at 22. The passer and kicker figures are such as to afford the players a passing and kicking game which more closely corresponds to the accuracy and range of actual human players in terms of the reduced distances represented by the gridiron formed on the playing surface 12.

As is well known, such electric football games provide for passing and kicking plays. A passing play is constituted by a projectile being propelled by the passing player 20 towards a receiving figure which can be any eligible figure in position on the board. The projectile hitting the intended receiver or opposing player results in either a completed pass or an intercepted pass, as the case may be. Similarly, the kicker 22 is provided for kicking field goals through the goals 14 or 16 and in order to execute punting plays.

The passing figure 20 (FIGS. 2-5) includes a base 24 which is provided with a player-like form 26 affixed thereto. The form 26 also has mounted thereto a mounting plate 28 secured by a socket screw 30 secured in a space position with an anchor member 32 secured between the form 26 and the mounting plate 28. Also mounted intermediately of the form 26 and the mounting plate 28 is a passing member 34 which is pivotally mounted on a dowel 36 passing into the mounting plate 28 and the form 26. The anchor member 32 extends in a generally horizontal position rearwardly of the form 26 and is provided with an upwardly extending projection 38 on its upper surface thereof.

Similarly, a pivotally mounted passing member 34 simulating a passer's arm is provided with a projection 40 each of which serve to seat either end of a compression coil spring 42, either end of which is received over the projections 38 and 40 respectively. The passing arm 34 is mounted such as to be freely pivotable about the pivot dowel 36 and thus is urged to a position shown on FIG. 2 away from the anchoring member 32. The form 26 is also provided with a stop dowel 44 which is positioned in the path of the passing member 34 such as to intercept the movement of the passing member 34 after release from a compressed position of the coil spring 42. The passing member 34 is provided with a pocket indicated at 46 which is sized to accept the projectile in play such as to be loosely disposed therein. The axis of the hole 46 extends normally to the radius of the rotation of the passing member 34 such that the projectile will be aligned therewith and be ejected from the pocket 46 with a minimal frictional contact with the pocket 46 in order to maximize the accuracy thereof. Similarly, the location of the stop dowel 44 is such as to cause the trajectory of release of the projectile of optimum accuracy. This corresponds to an inclination of approximately 30 degrees to the horizontal at release for the passing FIG. 20.

Projections 38 and 40 and compression spring 42 have a full retracted position beyond which the passing member 34 cannot go and in which case, the coil spring 32 is deflected out of position and the projections 38 and 40 are in abutment.

From this position, upon release, the spring rate of the coil spring 42 is such as to eject a projectile a distance to correspond to 50 to 60 yards on the playing surface 12 of the particular game configuration. This provides the realism in that the maximum range of the figure is in correspondence with the passing range of the average human passer. The accuracy of the pass has been found to be very good at shorter ranges and declines with longer ranges in a highly accurate simulation of actual playing conditions.

Figure 5:
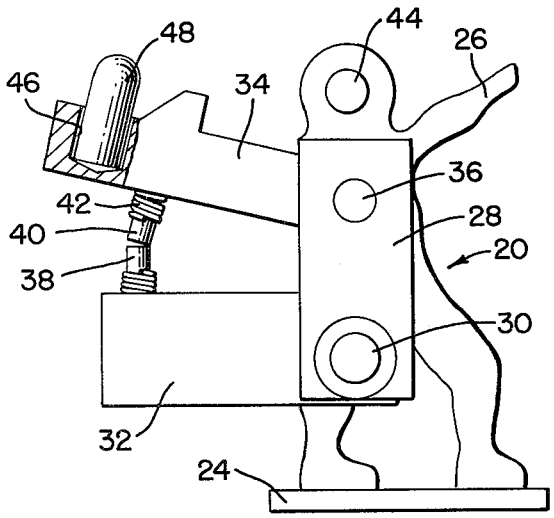
FIG. 5 is a view of the passing figure shown in FIGS 2–4 showing the passing member in the fully compressed maximum range position just prior to release thereof.
Figure 6:
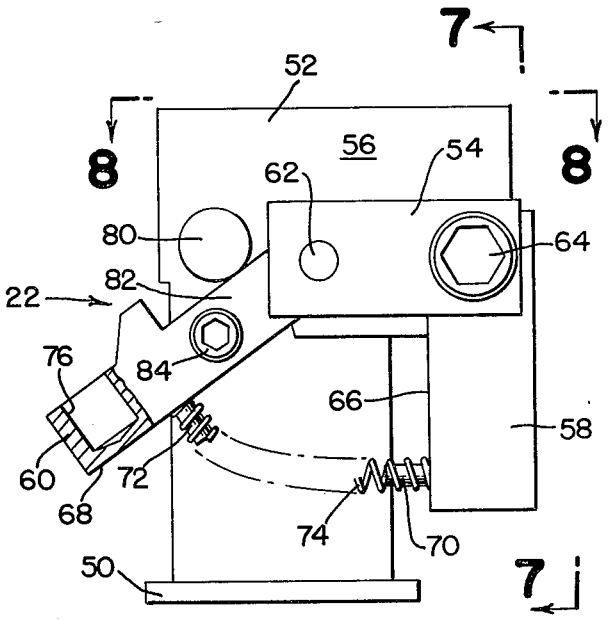
FIG. 6 is a side elevational view of a kicking figure according to the present invention.
Figure 7:
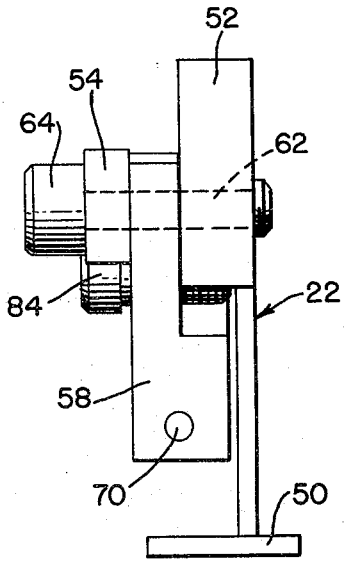
FIG. 7 is an front elevational view of the kicking figure shown in FIG. 6.
Figure 8:
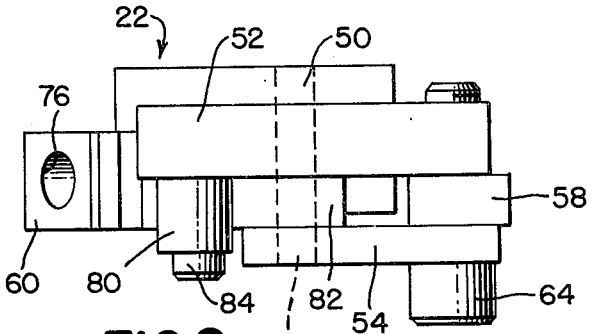
FIG. 8 is a top view of the kicking figure shown in FIGS. 6 and 7.
Figure 9:
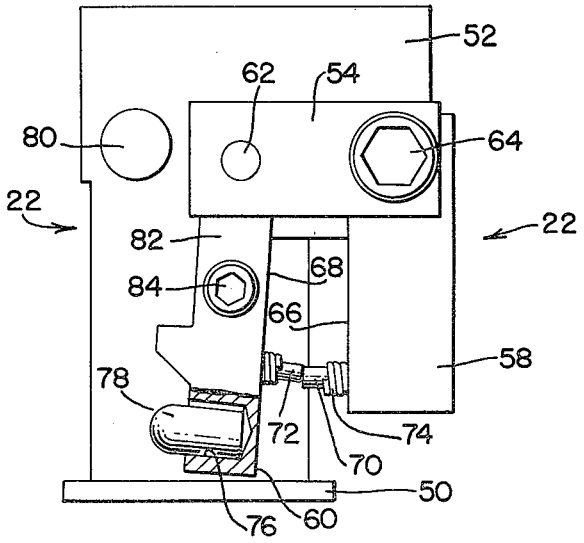
FIG. 9 is a side elevational view of the kicking figure shown in FIGS. 6–8 shown with the kicking member positioned in the fully retracted position for maximum range prior to release by the player.
Figure 10:
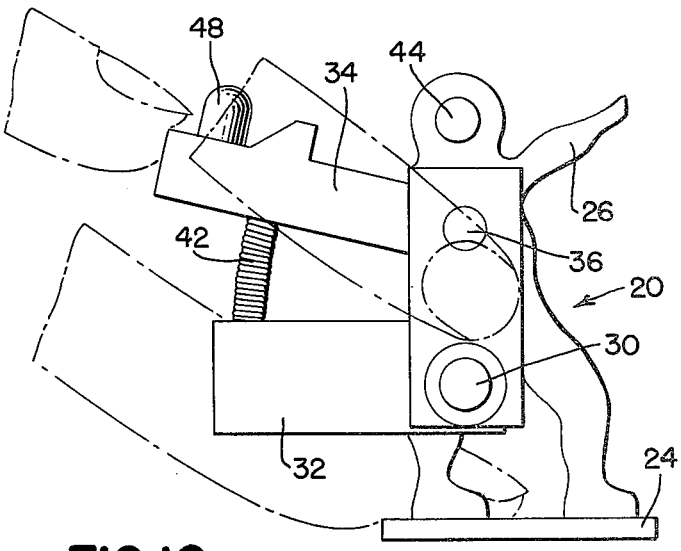
FIG. 10 is a side elevational view of a passing figure being manipulated by a player.

The player in use as can best be seen in FIG. 10 moves the passing member 34 about its pivotal support against the resistance of the compression spring 42 to an intermediate position corresponding to a specific range of the question of the pass desired to be executed up to the fully compressed and contacting position shown in FIG. 5. Upon release, the projectile 48 will be propelled in a highly accurate and closely simulated manner to actual game conditions in terms of the simulated playing field 12.

The kicking FIG. 22 is shown in FIGS 6–9 and is similar in configuration to the passing figure including a base 50 and a kicker form 52 (not shown as simulating the human kicker). Mounted to the form 52 is a mounting plate 54 spaced from the upper portion indicated at 56 of the form 52. An anchoring block 58 is also here provided but extends directly downward from an upper location of the mounting block 54. The mounting block 54 extends in a generally horizontal direction with the anchoring block 58 descending downwardly from a rearward location thereof.

Spaced forwardly of the anchoring block 58 is a kicking member 60 pivotally mounted on an axle dowel 62 extending through the mounting plate 54. The mounting plate 54 is mounted by means of a cap screw 64 extending through the anchor block 58. An axle 62 passes through the mounting plate 54 through one end of the kicking member 60 and thence into the upper side 56 of the form 52.

The forward face 66 of the anchor block 58 and the rear face 68 of the kicking member 60 are each provided with projecting elements 70 and 72 which projections may be afforded by Allen set screws projecting upwardly from the forward surface 66 and rear surface 68 of the anchoring plate 58 and kicking member 60 respectively. Disposed on either end thereof is a coil compression spring 74 in similar fashion to the passing figure. The ends of the projecting elements 70 and 72 provide a stop position of the kicking member 60 of the compression spring 74 in the fully compressed condition. This defines the maximum range of the projectile and as with the passing figure, the spring 74 is calibrated such as to cause a projectile to be propelled a corresponding distance to 50 or 60 yards on the playing surface 12. The kicking member 60 at forward face thereof is provided with a pocket 76 which is adapted to receive the elongate projectile 78 shown loosely disposed therein in FIG. 11 and in alignment with the pocket axis 76. Such axis also extends normally to the radius of rotation of the kicking member 60 in its pivotal movement about the dowel 62 such that the projectile is freely released from the pocket by movement of the kicking member 60 to the fully extended position at which a fixed dowel stop 80 intercepts the forward face 82 of the kicking member 60. The angle of the kicking member 60 in this position is such as to impose an approximately 60 degree upward trajectory angle of the projectile 18 at this point to correspond to produce trajectories of the projectile similar to a kicked football to correspond in keeping with the simulation of actual game conditions.

Figure 11:
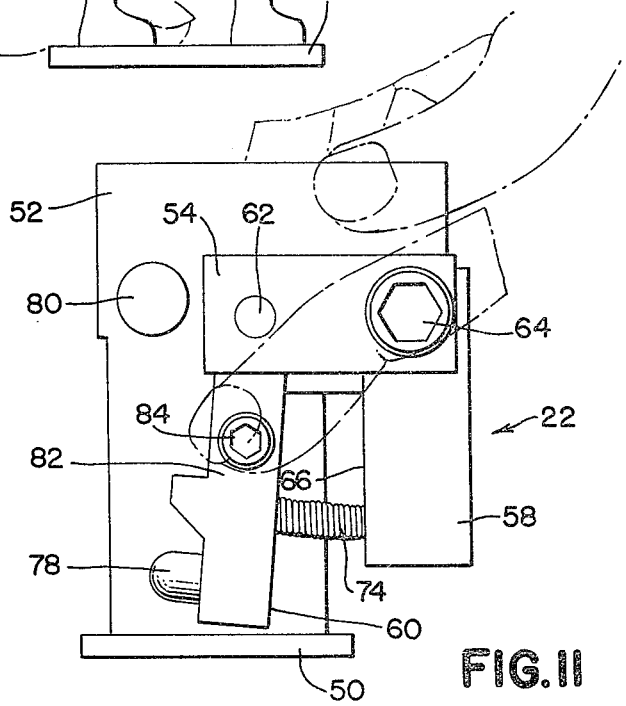
FIG. 11 is a side elevational view of a kicking figure being manipulated by a game player.

Accordingly, also a projecting set screw 84 may be provided in order to enable the player to manipulate the kicking arm 60 without blocking the movement of the releasing propelling movement affected on the projectile 78. This is shown in FIG. 11 where the player rotates the kicking member 60 to a position corresponding to the desired range and releasing the same for movement against the fixed stop 80 and the consequent propulsion of the projectile.

It has been determined that this arrangement introduces a highly accurate and closely simulated passing and kicking game into the electric football game of the type described, the range and accuracy corresponding closely to that of actual game conditions. This provides a much more sophisticated game playing capability, requiring skill levels of the players such as to enhance the interest of the game. At the same time the player configurations themselves are relatively simple and able to be manufactured in a relatively low cost, in keeping with the low manufacturing cost requirements for such game components.

What is claimed is:

1. An electric football game of the type comprising a playing surface marked with a gridiron corresponding to a football gridiron, means for vibrating the playing surface in order to advance a plurality of playing figures to be disposed on said surface and simulated play actions executed by vibratory movement of said playing surface causing said players to be advanced thereof, the improvement comprising:

a playing figure including a base adapted to be disposed on said playing surface, a figure form portion thereof, and a pivotally mounted member adapted to cause projection of a simulated football projectile; said member being pivotable about a pivotable mount thereon; spring means resiliently resisting said pivotal motion in one direction of movement; stop means associated with said member adapted to limit the motion of said member in said one direction against said resistance of said spring means; a forward limit stop associated therewith limiting the return movement of said member upon release thereof; and pocket means associated with said member adapted to receive a simulated football projectile upon release thereof causing said projectile to be propelled to simulate passing or kicking.

2. The electric football game according to claim 1 wherein said spring means is calibrated to produce a propelling of said projectile a distance on said playing surface corresponding to a simulated distance of 50–70 yards as indicated on said playing surface gridiron.

3. The electric football game according to claim 2 wherein said stop means for producing said limit of said retracting movement of said member includes a projecting element carried by said player figure opposite said member and a projecting element carried by said member; and wherein said spring means is interposed between said elements; and wherein said stop limit means comprises surfaces on said elements moved into engagement upon continued retracting movement of said member against said bias of said spring means whereby said retracting movement is limited.

4. The electric football game according to claim 3 wherein at least one of said players comprises a simulated passer figure wherein said member is adapted to rotate upwardly toward said forward limit stop and wherein said forward stop is located so as to propel said projectile at an angle that is approximately 30 degrees above the surface of said playing surface.

5. The electric football game according to claim 3 wherein said simulated player figure comprises a simulated kicker and wherein said member rotates from a downward position to an inclined vertical upper position and wherein said fixed stop means is located so as to project said projectile at an angle of approximately 60 degrees from the surface of said electric football game.

6. The electric football game according to claim 4 wherein said spring means comprises a compression helical spring anchored at either end to said respective elements.

7. The electric football game according to claim 3 wherein said pocket formed in said member comprises a generally cylindrical bore formed therein, and wherein the axis of said bore extends normally to the radius of rotation of said member in pivoting on said figure whereby said simulated football projectile is propelled there out of with minimal frictional engagement with said pocket whereby consistent accuracy of projection may be achieved.

* * * * *